United States Patent [19]

Woo

[11] 3,957,053

[45] May 18, 1976

[54] DETACHABLY CONNECTED ACUPUNCTURE NEEDLES

[76] Inventor: Yen Kong Woo, 1545 Geary St., Apt. 1, San Francisco, Calif. 94115

[22] Filed: Mar. 3, 1975

[21] Appl. No.: 554,537

[52] U.S. Cl. ..... 128/303.18; 128/329 A

[51] Int. Cl.[2] ..... A61H 39/00

[58] Field of Search ..... 128/303.18, 2.1 C, 2.1 E, 128/172.1, 404–406, 410, 411, 416–418, 329 A; 339/29 R, 29 B

[56] References Cited

UNITED STATES PATENTS

| | | | |
|---|---|---|---|
| 412,165 | 10/1889 | Cox | 128/411 |
| 550,688 | 12/1895 | Palmleaf | 128/417 |
| 631,733 | 8/1899 | Bonfils et al. | 128/417 |
| 1,210,316 | 12/1916 | Hollingshead | 128/303.18 |
| 2,276,623 | 3/1942 | Meiman | 128/417 |
| 2,278,986 | 4/1942 | Gibbs | 339/29 B |
| 2,294,934 | 9/1942 | Raasch | 339/29 R |
| 3,859,983 | 1/1975 | Dohring et al. | 128/2.1 C |
| 3,900,020 | 8/1975 | Lock | 128/2.1 C |

FOREIGN PATENTS OR APPLICATIONS

| | | | |
|---|---|---|---|
| 1,469,132 | 1/1967 | France | 128/419 PS |
| 677,402 | 3/1930 | France | 339/29 B |
| 8,448 | 7/1894 | Switzerland | 128/418 |
| 243,478 | 1/1947 | Switzerland | 128/404 |

OTHER PUBLICATIONS

Capperauld et al., "Acupuncture Anesthesis in China," Lameet, Nov. 25, 1972, pp. 1136–1137.

*Primary Examiner*—Robert W. Michell
*Assistant Examiner*—Lee S. Cohen

[57] ABSTRACT

At least two juxtaposed acupuncture needles for penetrating the muscles of a body, and a convoluted electrical conductor detachably bridging the heads of said juxtaposed needles. Additional needles may be positioned within the convolutions of the conductor.

2 Claims, 11 Drawing Figures

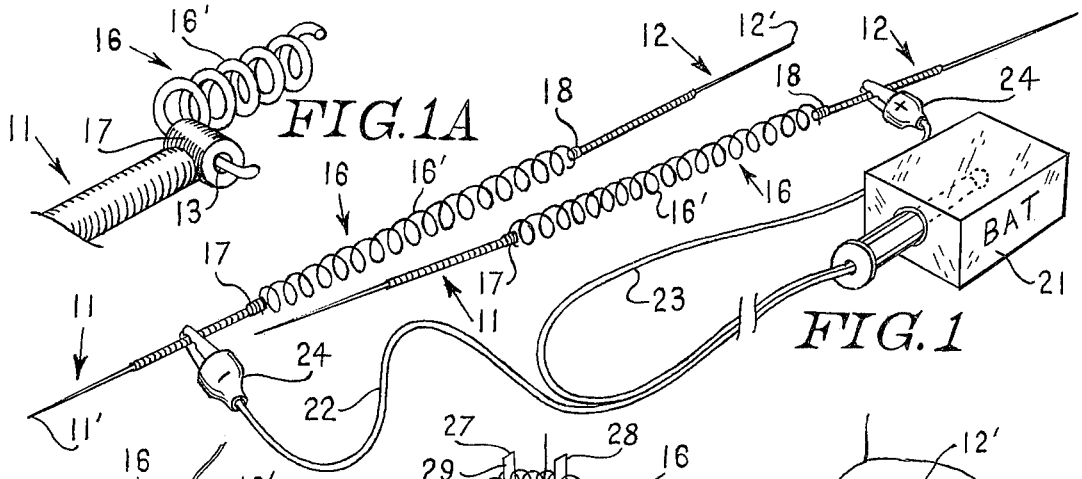
FIG. 1A
FIG. 1
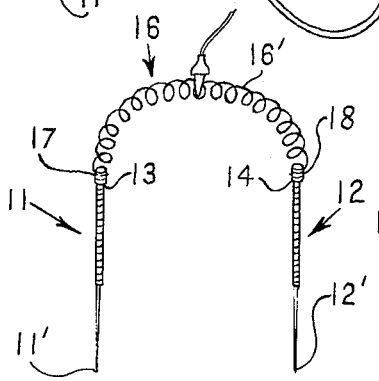
FIG. 2
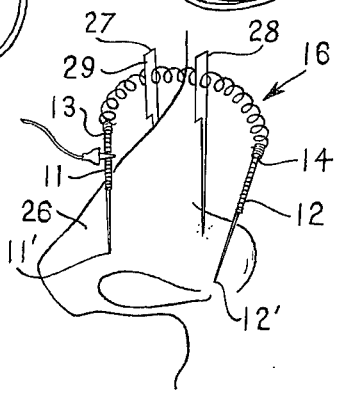
FIG. 3
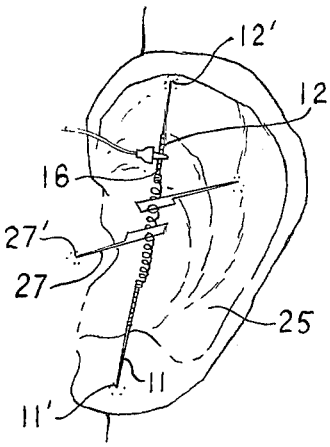
FIG. 4
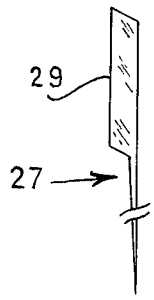
FIG. 5
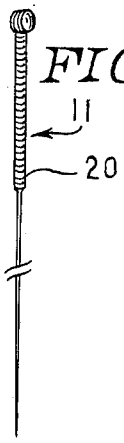
FIG. 5A
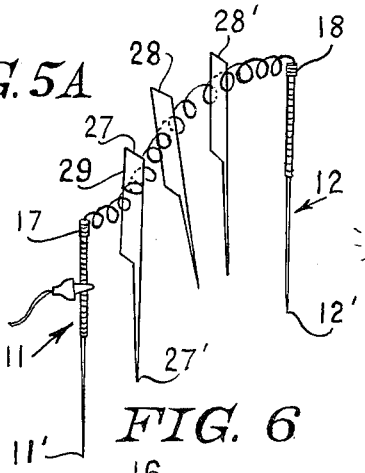
FIG. 6
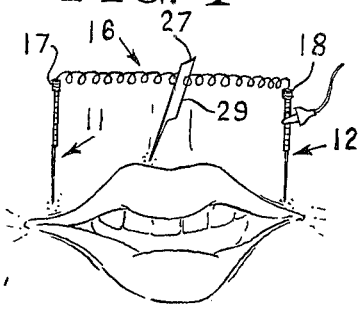
FIG. 7
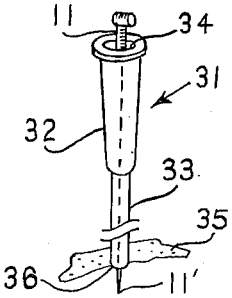
FIG. 8
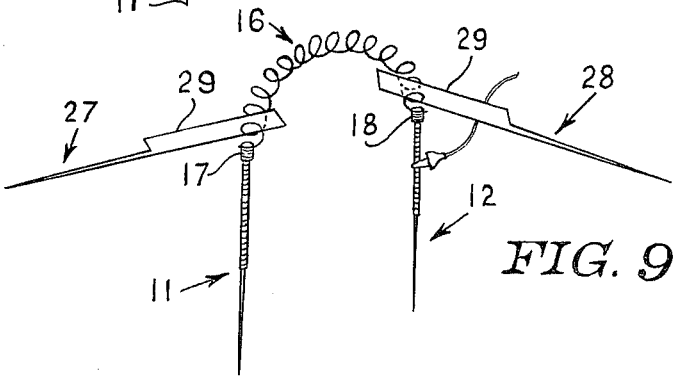
FIG. 9

DETACHABLY CONNECTED ACUPUNCTURE NEEDLES

Acupunctual therapy upon the human body and also upon animals has recently increased in this country to the extent that many of our States have licensed the practice of acupuncture. This type of therapy has been directed mainly to portions of the body which are relatively large and easily accessible, such as the shoulders, the back, as well as the arms and legs where no serious problems with respect to the placement of the needles and actuation thereof occur. My present invention is directed to the use of acupuncture needles in groups within relatively small portions of the body, such as the nose, face and ears, and to effect the treatment in these areas at a minimum discomfort to the patient yet in a most convenient, safe, and economical manner. This invention, moreover, constitutes an advance over my prior invention in ACUPUNCTURE NEEDLES AND HOLDER which is illustrated, described and claimed in my co-pending U.S. patent application, Ser. No. 541,933, filed Jan. 17, 1975.

A primary object of the present invention is to provide detachably connected acupuncture needles in a plurality of grouped arrangements within a relatively small area and actuatable at a minimum expense and equipment with maximum effeciency.

A still further object of my invention is to provide detachably connected acupuncture needles of the indicated nature which are additionally characterized by their capability of utilization in variable angular directions.

Another important object of my present invention is to provide detachably connected needles of the aforementioned character which can operatively support an excess of two or more connected needles whenever desired.

A still further object of the invention is to provide an expandable and contractible guide for enabling easy penetration of individual needles into the muscle of a human or an animal body thereby accommodating different lengths and guages.

Other objects of the invention, together with some of the advantageous features thereof, will appear from the following description of an embodiment thereof illustrated in the accompanying drawings which is an exemplification of the best mode of construction and manner of using the invention. It is to be understood that the appended claims are intended to cover the embodiment illustrated as well as variations thereof within the scope and purview of the invention.

Referring to the drawings:

FIG. 1 is a perspective view of the two pairs of oppositely directed and detachably connected acupuncture needles of the present invention, together with clip means for connecting the two pair of needles into a direct current circuit of low voltage.

FIG. 1A is an enlarged fragmentary detail of the head of a needle with broken view of an electrically conductive coil fastened thereto.

FIG. 2 is an elevational view of a pair of acupuncture needles arranged in spaced relationship in a common direction and bridged at the heads thereof by an electrically conductive coil exemplifying the best mode of construction and manner of using the invention.

FIG. 3 is a fragmentary perspective view of a modified embodiment of the invention supported on a human nose with added needles supported in the convolutions of the electrical conductor, and incorporating an electrical cord clipped thereto.

FIG. 4 is a fragmentary elevational view depictng a human ear in which multi-directional grouped acupuncture needles penetrating the nerves of the ear at different areas within the ear are illustrated.

FIG. 5 is an elevational view of a modified acupuncture needle which may be employed as a part of a grouped assembly of detachably connected needles of the present invention.

FIG. 5A is a broken elevational view of still another modified acupuncture needle employable with other needles of a detachably connected acupuncture assembly; this view illustrating an enlarged opening in the head of the needle and provided with a knurled section for easy gripping and manipulation of the needle.

FIG. 6 is a perspective view of a plurality of acupuncture needles bridged at their heads by an electrically conductive coil on which additional needles are supported; this view showing end needles of the type illustrated in FIG. 5A and intermediate needles of the type shown in FIG. 5.

FIG. 7 is a fragmentary front elevational view of the mouth and lips of a human with an assembly of detachably connected acupuncture needles piercing the upper lip in juxtaposition with the heads of the end juxtaposed needles bridged by a detachable electrically conductive coil.

FIG. 8 is a front elevational view of a expandable and rectractible guide in operative upright position resting on the outer surface of the skin of a human or other body and serving as a means for facilely inserting an acupuncture needle into the muscle.

FIG. 9 is a perspective view of detachably connected acupuncture needles of my present invention arranged in parallel juxtaposition; this view showing added needles supported at different angular positions in the convolutions of an electrically conductive coil bridging the heads of the parallel juxtaposed needles.

As a best mode of construction of my improvement and manner of using the same, my present invention comprises at least two juxtaposed acupuncture needles having an opening in the head of each thereof, together with an electrically conductive coil bridging the heads of said needles with the opposite ends of said coil hooked through the openings in the heads of said needles.

In accordance with my invention and as specifically illustrated in FIGS. 1 and 2 of the accompanying drawings at least two acupuncture needles, designated generally by the reference numerals 11 and 12, are provided and grouped together for acutuation together as a unit. Conventional stainless steel needles having holes 13 and 14 respectively, in the heads thereof, can be utilized for penetration into the skin of the patient receiving acupunctual treatment. The needles can be arranged in spaced parallel arrangement, as shown in FIG. 2 and detachably connected together at the heads thereof by means of a fine wire 16 fabricated from a suitable electrically conductive material such as copper and which is coiled in a multiplicity of convolutions 16' with one end 17 thereof hooked through opening 13 of needle 11 and the other end 18 of the wire hooked through the opening 14 of the juxtaposed needle 12. Instead of having the needles 11 and 12 arranged with their tips pointing in the same direction as shown in FIG. 2, the two needles 11 and 12 can be grouped so as to have one needle, say the needle 11 pointed in one direction and the other needle 12 in axial alignment with needle 11 but pointing in the opposite direction with the fine coiled wire 16 detachably connecting the heads of these oppositely directed needles by hooking the ends of the wire 16 through the holes 13 and 14 in the heads of the needles 11 and 12.

While each of the needles may be manually moved back and forth within the penetrated skin for stimulating given nerve areas that are weakened and that need some stimulation, these acupuncture needles can be actuated by passing a direct current of low voltage therethrough, such as by using a 9-volt battery, generally designated by the reference numeral 21 and capable of generating direct current flow through suitable electrically insulated cables 22 and 23 and metal clips 24 removably connected to the wire coil 16. The showing in FIG. 1 indicates that a single clip 24 can be detachably fastened to the copper wire 16 and the direct current from storage battery 21 will flow through the coil to both acupuncture needles 11 and 12 in the two sets of needles. It is clear from the view of FIG. 4 that not only one set of oppositely disposed needles 11 and 12 with connecting copper coil 16 can be used in an ear, designated by the reference numeral 25, but that a second or even a third similar set can be set up in juxtaposition to the same set within the ear 25.

In using my improved sets of detachably connected acupuncture needles, it is to be observed that the user in charge of the acupunctual treatment first inserts the pointed tip 11' of one needle 11 for the requisite distance into and below the outer surface of the skin, then attaches one end 17 of the copper coil 16 to such needle hooking such end through the eye or opening 13 thereof, thereafter inserts the tip 12' of the other needle 12 of the set the required distance below the skin of the patient, and finally attaches the opposite end 18 of the copper coil 16 by hooking such end through the eye or opening 14 of such other needle. The spacing between the needles 11 and 12 is determined by the attending user as evidenced by the location of the weakened nerve areas that are to be treated, with the needles in close juxtaposition and parallel to one another with the tips 11' and 12' thereof extending in the same direction. If the user desires to manipulate the needles by moving them with his fingers he may do so if there is sufficient space for grasping the detachably connected sets. Or, he may connect the set to a source of low voltage electrical current using a storage battery and connected electrically conductive cables having clips thereon for attaching the conductors directly to either one of the two needles of each set or directly to the connector copper wire 16. It is to be understood that more than one set of connected needles 11 and 12 can be introduced into the body of a patient at selected areas thereof. Two or more sets with two needles to a set can be inserted on the nose 26, see FIG. 3, or additional needles 27 and 28, of special construction can be removably mounted on the tightly wound copper coil 16; such special needle construction comprising a laterally extending blade section 29 having a relatively thin edge which can easily be supported between adjacent convolutions of the wire coil 16; see FIG. 5 for such needle construction and FIGS. 3, 4, 6, 7 and 9 for the support of the specially constructed needles upon the wire coil.

In accordance with my present invention, two juxtaposed acupuncture needles which are detachably connected together by the wire coil 16 with the tips thereof extended in the same direction, see FIG. 2, can be employed for accomplishing acupuncture treatment in a given size area of the body, or two or more sets of such pair of detachably connected needles can be utilized in the same area with the added sets of two needles each arranged in close juxtaposition. In such instances of use, the several needles of all of the grouped sets of needles are preferably electrically rather than manually controlled because of the limited amount of space between each set. As indicated in FIGS. 3 and 6 of the accompanying drawings, the two needles detachably connected group of FIG. 2 can be augumented by the addition of two or the addition of three specially constructed needles, respectively, designated 27 and 28 in FIG. 3 and designated 27, 28 and 28' in FIG. 6; such specially constructed needles containing laterally extending portion 29 which is fitted between adjacent coils 16' of the connector coil 16. Or, the sets of detachably connected needles may comprise two end needles 11 and 12 bridged by a wire coil 16 and a single specially constructed needle 27, as shown in FIG. 7 for treating the upper lip of the mouth of a person. While FIGS. 1, 3 and 6 illustrate the needles all pointing in the same direction, an added specially constructed needle 27 can be mounted with its tips 27' extending at an angle with respect to the tips 11' and 12' of the two end needles 11 and 12, respectively. As illustrated in FIG. 4, the set or sets of detachably connected acupuncture needles 11 and 12 piercing areas of the ear 25 of a person at diametrically opposite areas can include a specially constructed needle 27 which is removablly mounted on the wire coil 16 can be so mounted as to direct its pointed tip 27' at substantially a right angle, or other angular relationship to the pointed tips 11' and 12' of the other two axially aligned needles 11 and 12. Thus various or different areas of the inner ear can be pierced by a number of needles of varying lengths for acupunctual treatment of the weakened nerve areas in the ear. Because of lack of space, the several needles of the sets utilized within the ear are electrically energized to stimulate the weakened nerve areas, rather than manually. The broken elevational view of FIG. 5A illustrates that the needles may be long or short dependent upon the area of the body to be treated or the available space for mounting of the needles in close juxtaposition for simultaneous actuation thereof manually or electrically.

By virtue of the fact that all of the acupuncture needles in each set thereof are of relatively small cross-section or small guage, I provide an expandable and contractible guide 31 for facilitating the insertion of the needles into the various areas of the body. The guide 31 is conveniently constructed of a pair of telescopically arranged sections 32 and 33 having a central passage 34 extending therethrough and opening to the top and bottom of the guide. Each needle is threaded through passage 34 into the underlying skin 35 of the patient with the lower end 36 of the guide resting on the outer surface of the skin. After inserting each needle, the guide 31 is removed and used again and again for inserting each additional needle, it being understood that sections 32 and 33 of the guide can be moved apart for the longer needles and brought close together for the shorter needles.

The detachably connected acupuncture needles of my present invention are economical in construction and inexpensive to use. However, because of their capability of being mountable in close juxtaposition in sets, they can be specially employed in small areas with facility as well as in normal and large areas too. The electrically conductive coil 16 can consist of relatively short length convolutions, such as ¼ inch to ½ inch in length, or can be of greater length, such as ¾ inch to 1¼ inches, as desired, with the convolutions in tightly compact arrangement. The convolutions thus enabling stretching the coil to some extent to facilitate placement of the juxtaposed needles.

It is to be understood that the appended claims are intended to cover the embodiments illustrated in the accompanying drawings as well as variations thereof within the scope and purview of my present invention.

I claim:

1. At least two acupuncture needles of electrically conductive material arranged in closely spaced apart juxtaposition; each of said needles comprising a head having an opening therein, a body porton of relatively small cross-section and a pointed tip of a size for penetrating the skin of a person to reach weakened muscles and nerve areas in the nose and ear and upper lip of the mouth of the body, a flexible connector of electrically conductive material in convolute form having its opposite ends hooked through the openings in said juxtaposed needles enabling operatively positioning of said needles relative to one another within a radii of 360°, and at least one additional needle of electrically conductive material and comprising a head, a body portion of relatively small cross-section and a pointed tip of a size for penetrating the skin of a person removably secured proximate its head witin the convolutions of said flexible connector.

2. The combination set forth in claim 1 wherein said additional needle comprises a lateral extension thereon between the head and tip thereof which is the point of connection of said additional needle to the convolutions of said flexible connector.

* * * * *